US007195535B1

(12) United States Patent
Swedek et al.

(10) Patent No.: US 7,195,535 B1
(45) Date of Patent: Mar. 27, 2007

(54) METROLOGY FOR CHEMICAL MECHANICAL POLISHING

(75) Inventors: Boguslaw A. Swedek, Cupertino, CA (US); Dominic J. Benvegnu, La Honda, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/187,612

(22) Filed: Jul. 22, 2005

Related U.S. Application Data

(60) Provisional application No. 60/590,730, filed on Jul. 22, 2004.

(51) Int. Cl.
*B24B 49/12* (2006.01)
*B24B 7/22* (2006.01)

(52) U.S. Cl. ..... 451/5; 451/6; 451/288

(58) Field of Classification Search ..... 451/5, 451/41, 57, 288, 287, 291, 292
See application file for complete search history.

(56) References Cited

U.S. PATENT DOCUMENTS 5,081,796 A 1/1992 Schultz
5,658,183 A * 8/1997 Sandhu et al. ..... 451/5
5,672,091 A 9/1997 Takahashi et al.
5,872,633 A 2/1999 Holzapfel et al.
5,958,148 A 9/1999 Holzapfel et al.
6,068,545 A * 5/2000 Arai ..... 451/288
6,086,457 A * 7/2000 Perlov et al. ..... 451/41
6,132,289 A * 10/2000 Labunsky et al. ..... 451/6
6,213,844 B1 4/2001 Lenkersdorfer
6,217,410 B1 4/2001 Holzapfel et al.
6,447,370 B1 9/2002 Weldon

* cited by examiner

*Primary Examiner*—Robert A. Rose
(74) *Attorney, Agent, or Firm*—Fish & Richardson

(57) ABSTRACT

Methods and apparatus for providing metrology for chemical mechanical polishing. A chemical mechanical polishing system includes a first polishing station, a second polishing station, a transport device, and a first measuring station. The transport device is configured to hold a workpiece during polishing at the first and second polishing stations and to move the workpiece from the first polishing station to the second polishing station. The first measuring station is situated to measure a characteristic of the workpiece when the transport device is holding the workpiece and when the workpiece is not in contact with a polishing pad of any of the first polishing station and the second polishing station.

30 Claims, 9 Drawing Sheets

METROLOGY FOR CHEMICAL MECHANICAL POLISHING

CROSS-REFERENCE TO RELATED APPLICATIONS

This application claims the benefit of prior U.S. provisional application 60/590,730, filed Jul. 22, 2004, which is incorporated by reference herein.

BACKGROUND

The present invention relates generally to chemical mechanical polishing of substrates, and more particularly to metrology for process control, such as end point determination.

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the non-planar surface is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non-planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing disk pad or belt pad. The polishing pad can be either a standard pad or a fixed-abrasive pad. A standard pad has a durable roughened surface, whereas a fixed-abrasive pad has abrasive particles held in a containment media. The carrier head provides a controllable load on the substrate to push it against the polishing pad. A polishing slurry, including at least one chemically reactive agent, and abrasive particles if a standard pad is used, is supplied to the surface of the polishing pad.

One problem in CMP is determining whether the polishing process is complete, i.e., whether a substrate layer has been planarized to a desired flatness or thickness, or when a desired amount of material has been removed. Overpolishing (removing too much) of a conductive layer or film leads to increased circuit resistance. On the other hand, underpolishing (removing too little) of a conductive layer leads to electrical shorting. Variations in the initial thickness of the substrate layer, the slurry composition, the polishing pad condition, the relative speed between the polishing pad and the substrate, and the load on the substrate can cause variations in the material removal rate. These variations cause variations in the time needed to reach the polishing endpoint. Therefore, the polishing endpoint cannot be determined merely as a function of polishing time.

One way to determine the polishing endpoint is to remove the substrate from the polishing surface and examine it. By way of example, the substrate can be transferred to a metrology station where the thickness of a substrate layer is measured with a profilometer or a resistivity measurement.

If the desired specifications are not met, the substrate is reloaded into the CMP apparatus for further processing. This reloading is a time-consuming procedure that reduces the throughput of the CMP apparatus. Alternatively, the examination might reveal that an excessive amount of material has been removed, rendering the substrate unusable.

More recently, in-situ monitoring of the substrate has been performed, for example, with optical or eddy current sensors, in order to detect the polishing endpoint. Other proposed endpoint detection techniques have involved measurements of friction, motor current, slurry chemistry, acoustics and conductivity.

SUMMARY

In one aspect, the invention is directed to a chemical mechanical polishing system that includes a first polishing station, a second polishing station, a transport device, and a first measuring station. The transport device is configured to hold a workpiece during polishing at the first and second polishing stations and to move the workpiece from the first polishing station to the second polishing station. The first measuring station is situated to measure a characteristic of the workpiece when the transport device is holding the workpiece and when the workpiece is not in contact with a polishing pad of any of the first polishing station and the second polishing station.

In the instant specification, the term workpiece refers generally to a piece being polished. A work piece can be any sort of substrates, for example, a product wafer that includes multiple units of memory, a test wafer, and a gating wafer.

In another aspect, the invention is directed to a chemical mechanical polishing method that includes polishing a workpiece with a first polishing pad at a first polishing station. The method includes transporting the workpiece from the first polishing station to a second polishing station that includes a second polishing pad, wherein transporting is done by a transport device that includes one or more carrier heads. The method includes measuring a characteristic of the workpiece when the workpiece is being held by the transport device and when the workpiece is not in contact with either the first or second polishing pads.

Possible advantages of implementations of the invention can include one or more of the following. Sufficient data can be collected to improve control of a CMP polishing process while reducing or minimizing adverse effects on throughput capacity. Measurements can be made simultaneously on more than one substrate in the CMP tool. Measurements can be made on a portion of the substrate that is substantially free of slurry and other polishing residue, and the signal to noise ratio of signals received by sensors is consequently improved.

Other features and advantages of the invention will become apparent from the following description, including the drawings and claims.

BRIEF DESCRIPTION OF THE DRAWINGS

Like reference symbols in the various drawings indicate like elements.

DETAILED DESCRIPTION

Figure 1:
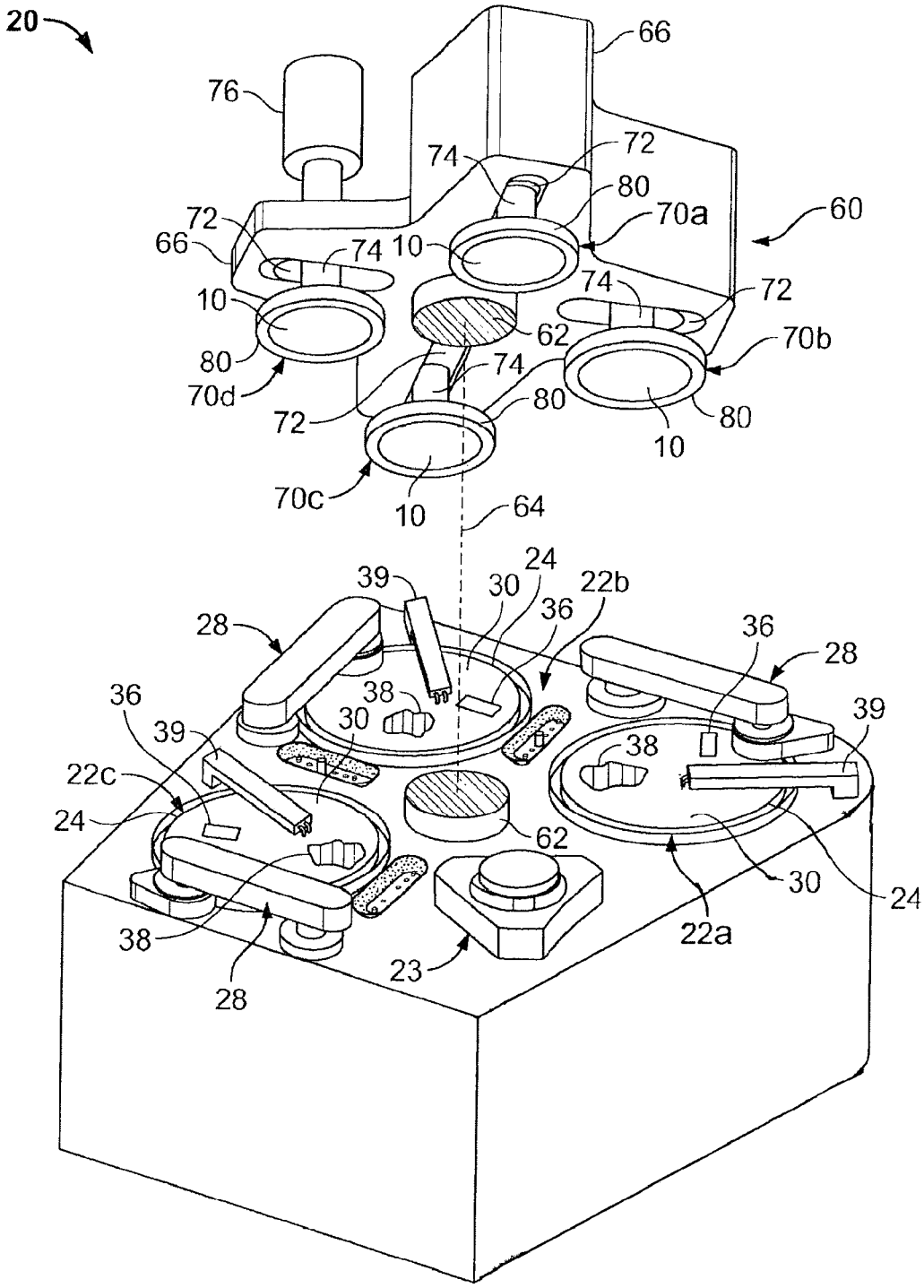
FIG. 1 is a schematic exploded perspective view of a chemical mechanical polishing apparatus.

FIG. 1 shows a CMP apparatus 20, which can polish one or more substrates, for example, substrate 10. A description of a similar polishing apparatus 20 can be found in U.S. Pat. No. 5,738,574, the entire disclosure of which is incorporated herein by reference. Polishing apparatus 20 includes a series of polishing stations 22*a*, 22*b* and 22*c*, and a transfer station 23. The transfer station 23 transfers the substrates between a carrier head and a loading apparatus.

Each polishing station can include a rotatable platen 24 on which is placed a polishing pad 30, which can be, for example, a two-layer polishing pad, a fixed-abrasive pad with embedded abrasive particles, or a relatively soft pad. Each polishing station can also include a pad conditioner apparatus 28 to maintain the condition of the polishing pad so that it will effectively polish substrates.

During a polishing step, a polishing liquid 38, for example, an abrasive slurry or abrasive-free solution, can be supplied to the surface of the polishing pad 30 by a slurry supply port or combined slurry/rinse arm 39. Different slurry solutions may be used at different polishing stations.

A rotatable multi-head carousel 60 supports four carrier heads 70*a*–70*d*. The carousel 60 is rotated by a central post 62 about a carousel axis 64 by a carousel motor assembly (not shown) to orbit the carrier heads and the substrates attached thereto between the polishing stations 22*a*–22*c* and the transfer station 23. The carrier heads can be spaced at substantially equal angular intervals around the carousel axis 64. Similarly, the polishing stations and the transfer station can be arranged at substantially equal angular intervals around the carousel axis 64. Three of the four carrier heads can receive and hold substrates, including polishing them by pressing them against the polishing pads, during which time, the fourth of the carrier heads can deliver a polished substrate to the transfer station 23 and receive an unpolished substrate from the transfer station 23. Furthermore, the carrier heads can move their respective substrates in directions parallel to the carousel axis 64. That is, the carrier heads can move the substrate toward and away from the platen surface. Descriptions of a suitable carrier head 70 can be found in U.S. Pat. Nos. 6,422,927 and 6,857,945, the entire disclosures of which are incorporated by reference.

Each carrier head is connected by a carrier drive shaft 74 to a carrier head rotation motor 76 (shown by the removal of one quarter of cover 68) so that each carrier head can independently rotate about it own axis. In addition, each carrier head can independently and laterally move, including oscillate, in a radial slot 72 formed in a carousel support plate 66.

During polishing, the carrier heads press their respective substrates against the corresponding polishing pad, the platens are rotated about their central axis, and the carrier heads are rotated about their respective central axes and translated laterally across the surface of the polishing pad.

Figure 2A:
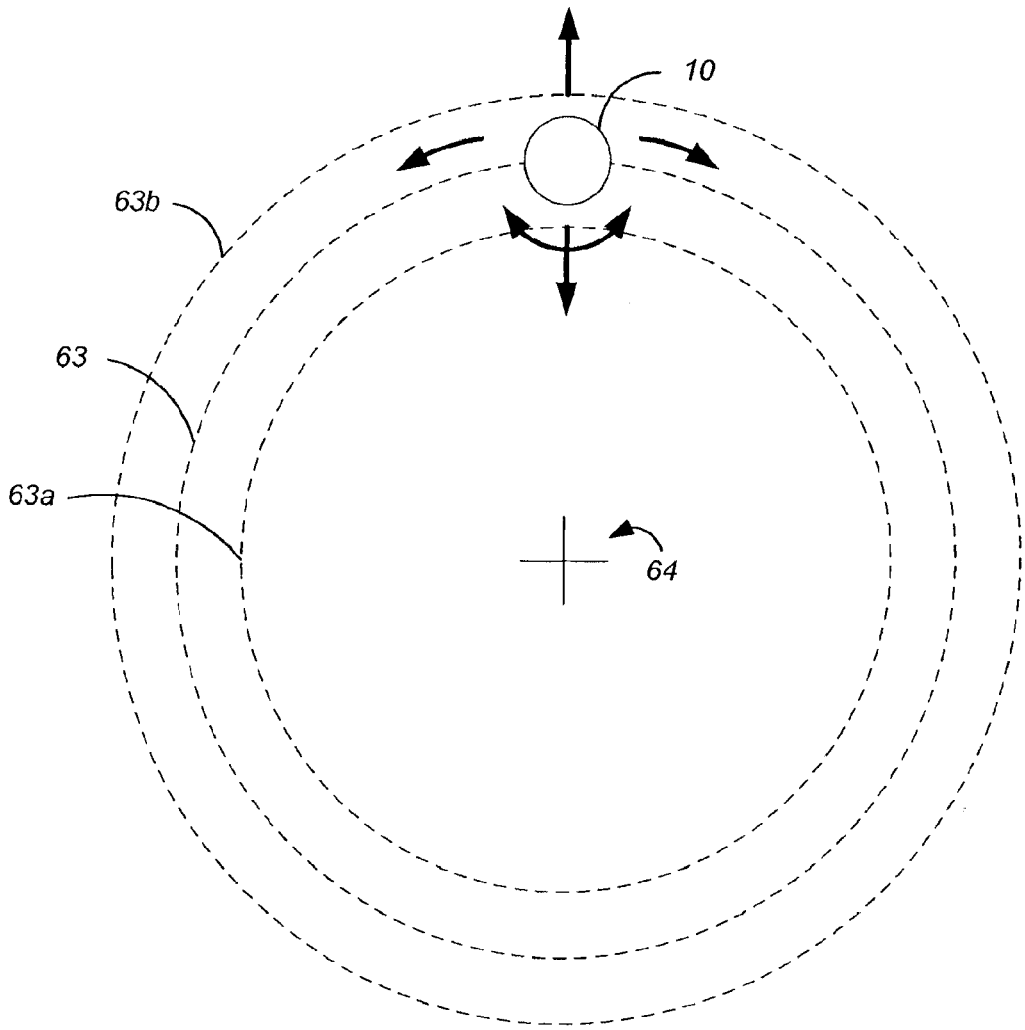
FIGS. 2A and 2B show paths along which a carousel of the apparatus can carry a substrate.
Figure 2B:
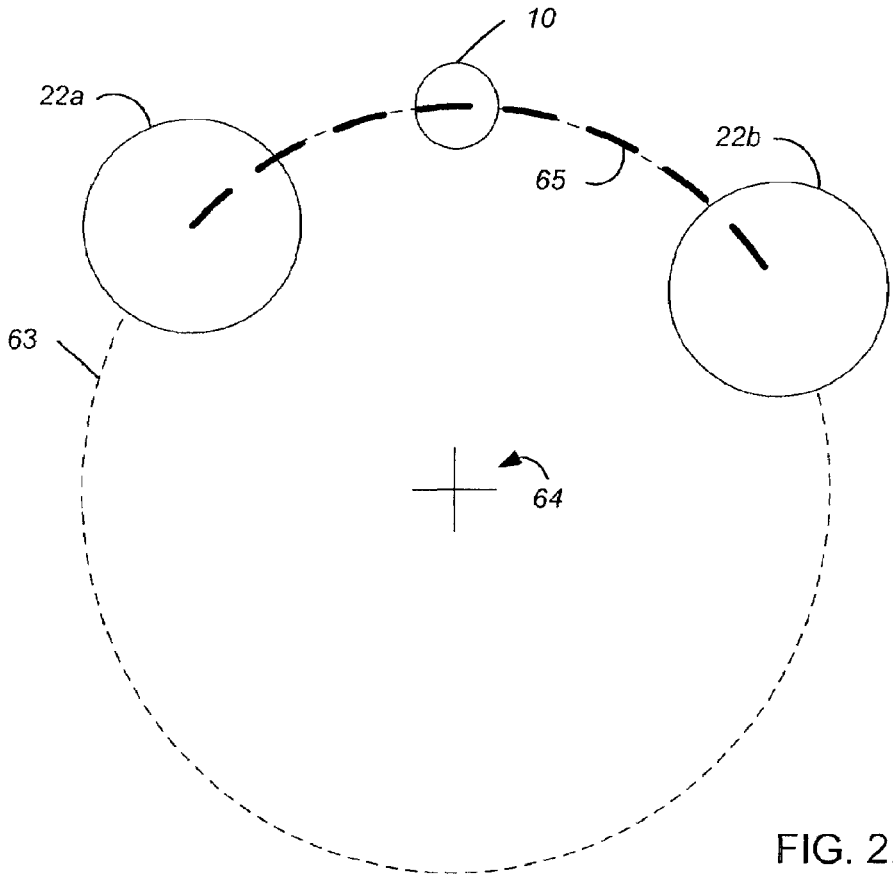

Paths along which the carousel 60 and its carrier heads can carry a substrate are described in reference to FIGS. 2A and 2B. FIG. 2A illustrates a circular path 63, along portions of which the carousel 60 can move a substrate. The carousel axis 64 is the center of the circular path 63. (Although the carousel 60 can carry multiple substrates, only one substrate is shown in FIGS. 2A and 2B for ease of exhibition.) The substrate is being held by a carrier head that is positioned at a particular position along the corresponding radial slot. To move the substrate 10 along the circular path 63, the position of the carrier head along the radial slot is maintained while the carousel 60 rotates so that the substrate orbits around the carousel axis 64. While the carousel 60 is moving the substrate 10 along the circular path 63, the carrier head can rotate the substrate 10 about the axis of rotation of the carrier head. (The thick arrows indicate some of the possible degrees of freedom of movement available to the carousel and carrier head.)

The carousel 60 can move the substrate 10 along paths other than that shown in FIG. 2A by repositioning the carrier head holding the substrate in other positions along the radial slot 72. The innermost and outermost circular paths through which the substrate can be moved are illustrated by phantom lines 63*a* and 63*b*, respectively, corresponding to the innermost and outermost positions of the carrier head in the radial slot. Instead of a circular path, the carousel 60 can move the substrate along a spiral or elliptical path by translating the carrier head along its radial slot while rotating about the carousel axis 64. As indicated above, the carousel 60 can hold four substrates and can move the substrates along different paths, either circular or elliptical.

To move substrates from station to station, the multi-head carousel 60 carries a substrate along a path that is a portion of one of the possible paths described above, for example, a circular arc or a segment of an elliptical or spiral path. FIG. 2B provides an example in which the carousel 60 moves the substrate 10 from the first polishing station 22*a* to the second polishing station 22*b*. The path along which the carousel 60 moves the substrate 10 is an arc 65 of the circular path 63.

The CMP apparatus 20 can include one or more in-situ monitoring modules that can determine a change in the thickness of a film on the substrate. The in-situ monitoring module is situated such that the determination can be made in real-time and while the film is being polished. Each polishing station can include an independent in-situ monitoring module. For example, an in-situ monitoring module can be situated in a recess that is formed in platen 24. Each in-situ monitoring module can include one or more different types of monitoring systems such as an eddy current monitoring system, for example, as described in commonly owned U.S. patent application Ser. No. 10/633,276, an optical monitoring system, for example, as described in U.S. Pat. No. 6,159,073, or a friction-based monitoring system, for example, as described in U.S. patent application Ser. No. 10/977,479, each of which is incorporated by reference. The in-situ monitoring system can function as a polishing process control and endpoint detection system. A suitable in-situ monitoring module is further described in commonly owned U.S. patent application Ser. No. 10/124,507, filed on Apr. 16, 2002, and Ser. No. 10/123,917, also filed on Apr. 16, 2002, which are hereby incorporated by reference in their entireties.

The CMP apparatus 20 includes one or more inter-platen monitoring modules configured to effect measurements of a substrate while the substrate is being held by the carrier head but is not in contact with a polishing pad. The inter-platen monitoring modules can include any combination of the above described eddy current, optical, and friction based monitoring systems. Additionally, the inter-platen monitoring module can include an optical monitoring system that uses white light. The white light system can use white light having wavelengths, for example, between 200–800 nanometers. Alternatively, white light having other wavelengths can be used. The white light optical system includes one or more light sensors to measure light intensity and a controller that applies principles of refractometry, spectometry, and/or elipsometry to calculate film thickness or changes in film thickness.

Figure 3:
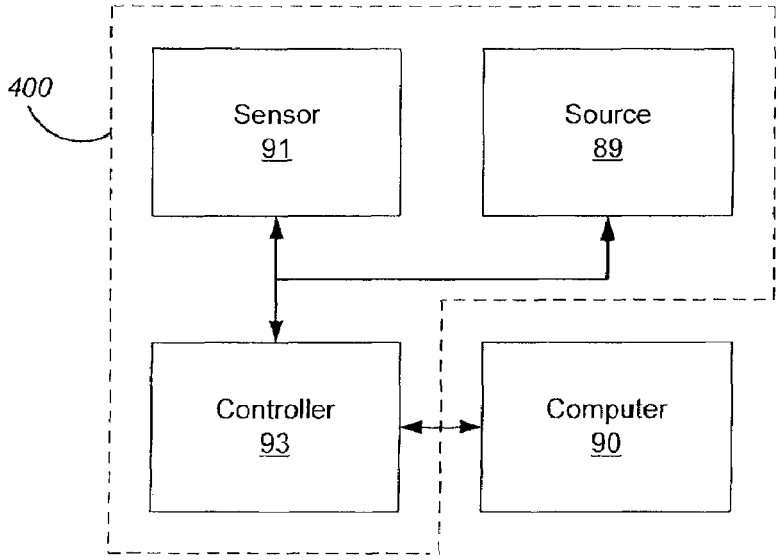
FIG. 3 shows an implementation of an inter-platen monitoring module.

FIG. 3 shows an implementation 400 of an inter-platen monitoring module. The implementation 400 includes source 89, sensor 91, and controller 93 for the source and sensor. The source 89 can be a white light source, and the sensor 91 can be a white light sensor. The implementation 400 can include multiple sources and multiple sensors.

The source 89 and the sensor 91 can be configured and connected to exchange information with a controller 93, which in turn can be configured and connected to exchange information with a computer 90. The computer 90 can be a general purpose computer that is configured to control the CMP apparatus 20.

The inter-platen monitoring module need not include a light source, a light sensor, or controller for the light source and the light sensor as these components can be located outside of the module. One or more optical fibers can convey light from the light source to the module, which directs the light to a substrate being measured. One or more optical fibers can convey light received at the module to the light sensor. The same optical fibers can be used for conveying light from the light source and for conveying light to the sensor. The optical fibers can be bifurcated. The inter-platen monitoring module can thus be reduced in size. Moreover, one controller can provide the requisite control for multiple inter-platen monitoring modules.

The inter-platen monitoring modules can be situated so that they can take measurements of the substrate without significant impact on the throughput capacity of the CMP apparatus 20. In particular, an inter-platen monitoring module can be positioned so that (i) the time needed to transport a substrate from a first station (either polishing or transfer) to a position where the module can effect one or more measurements plus the time needed to transport the substrate from the position to a second station (either polishing or transfer) do not significantly vary from (ii) the time that would be needed, if no inter-platen monitoring were performed, to transport the substrate from the first station to the second station. A position where the inter-platen monitoring module can effect one or more measurements is generally one that is within in the working range of sensors and emitters of monitoring systems of the module. A position over a module, for example, is one where one or more measurements can be effected. Note that the first and second polishing stations can perform sequential polishing steps. In some implementations, transporting can include slowing down or stopping motion. That is, the carousel and carrier head can slow down or stop their moving of the substrate while transporting the substrate from one station to another. In other implementations, transporting is performed without slowing or stopping motion of the substrate.

Figure 4A:
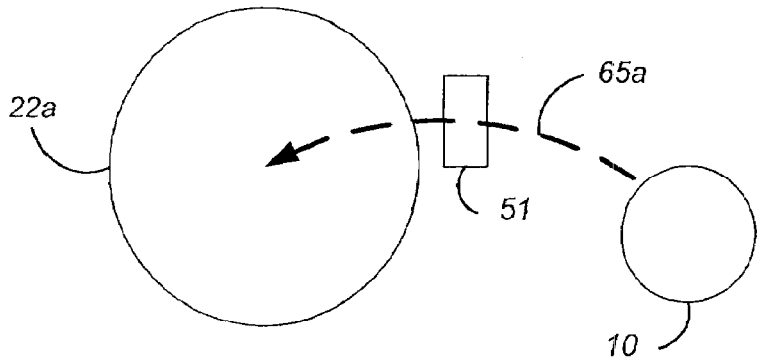
FIGS. 4A–4C show examples of paths over a substrate surface, along which measurements can be taken.
Figure 4B:
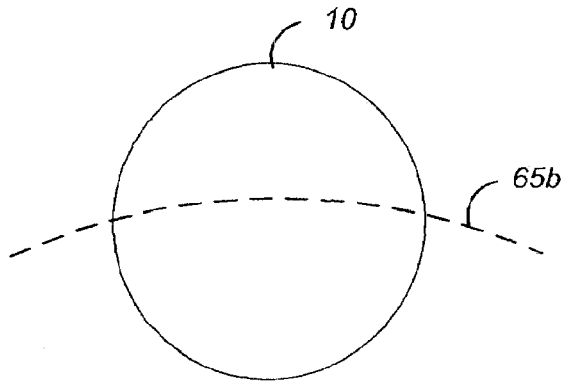
Figure 4C:
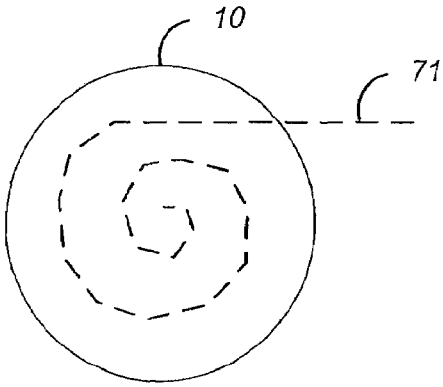

As shown in FIG. 4A, an inter-platen module 51 can be positioned along a path 65*a* traversed by the substrate 10. As shown in FIG. 4B, the inter-platen module 51 can perform a series of measurements along path 65*b* as the carousel 60 moves the substrate 10 across the module. In this case, measurements are taken while the carousel 60 rotates about the carousel axis 64. Optionally, the carousel 60 can temporarily slow down its rotation about the carousel axis 64 while measurements are being taken. Alternatively, the carousel 60 can position the substrate over the inter-platen module 51 and then stop rotating about the carousel axis 64 and hold the substrate still until measurements are completed. In general, however, the carousel 60 will not reverse direction. In any case, the carrier head holding the substrate can move the substrate toward the module 51 so that the surface of the substrate is closer to the module 51. In addition, the carrier head can rotate about its own axis of rotation and/or translate along the radial slot so that the sensors of the inter-platen module can take measurements at different points of the substrate surface. FIG. 4C provides an example in which measurements are taken along a spiral path 71, resulting from rotation of the carrier head while the carrier head translates angularly over the one or more sensors of the inter-platen monitoring module. Note that the inter-platen module 51 can include a sensor or, alternatively, a mechanism for conveying signals to a sensor located outside of the module (for example, an optical fiber).

As discussed above, the inter-platen modules are situated at a point along one of the above described paths used to transfer substrates between stations (which can be consecutive stations) of the CMP apparatus 20. The inter-platen module can take measurements as the substrate is being transferred from station to station so that substantially no additional time is needed beyond that required to make the transfer. For example, the carousel 60 and the carrier head holding the substrate can move as though no measurements are being taken. Thus, re-programming of the movements for the carousel and carrier heads is not necessary if the inter-platen monitoring module is installed as a retro fit in the CMP apparatus. Retrofitting can but does not necessarily include, for example, replacing a platen and polishing pad assembly that does not include inter-platen modules with one that does.

Figure 5:
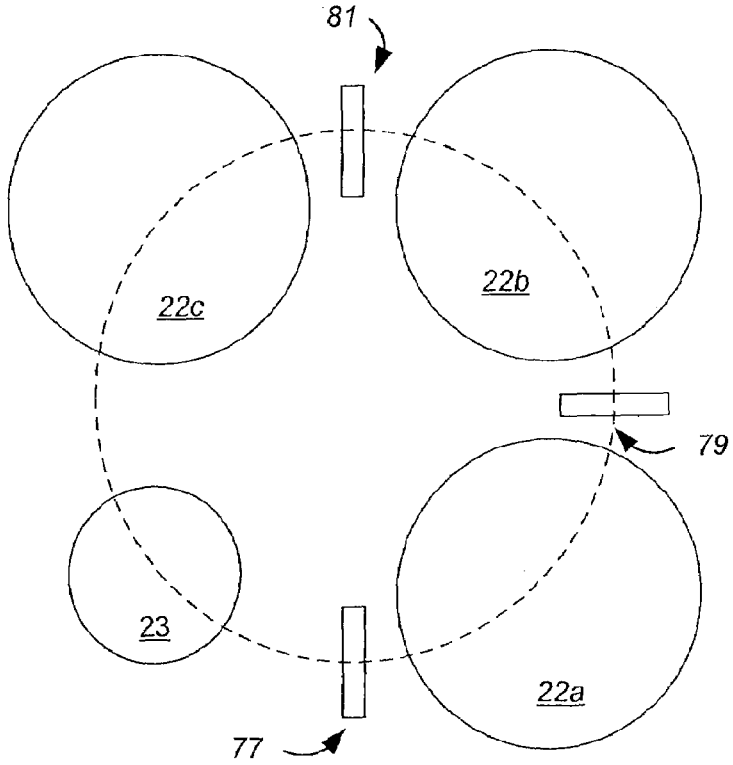
FIG. 5 one arrangement of inter-platen modules.

The number of inter-platen monitoring modules required generally depends on the polishing recipe. In general, there should be a sufficient number of modules so that measurements can be taken as needed to provide proper control of the polishing process. By way of example, consider a polishing process that includes three polishing steps performed sequentially at the first, second, and third polishing stations situated as shown in FIG. 5. The substrate is first polished in a first polishing step at the first polishing station, then moved to and polished in a second polishing step at the second polishing station, and then moved to and polished in a third polishing step at the third polishing station. The first, second, and third polishing steps can have different removal rates and remove 90%, 9%, and 0.9%, respectively, of the film. Alternatively, the polishing steps can have substantially the same polishing rates.

In this case, assume that proper control requires measurements to be taken before each polishing step. Consequently, three inter-platen modules are needed. Module 77 measures thickness before the first polishing step. Module 79 measures thickness before the second polishing step. Module 81 measures thickness before the third polishing step.

Note that, in general, an n number of substrates can be measured simultaneously when there are n inter-platen monitoring modules and at least n number of carrier heads. The implementation of FIG. 5 for example, where there are three inter-platen modules and four of carrier heads, three substrates can be measured simultaneously. Sensors of the three inter-platen modules are positioned so that when one substrate being held by a carrier head is positioned over the sensors of one module, two other substrates being held by other carrier heads of the carousel are also positioned over the sensors of the other two modules. Three substrates can thus be measured at one time and the effect of measurement on throughput can be minimized or reduced.

Figure 6A:
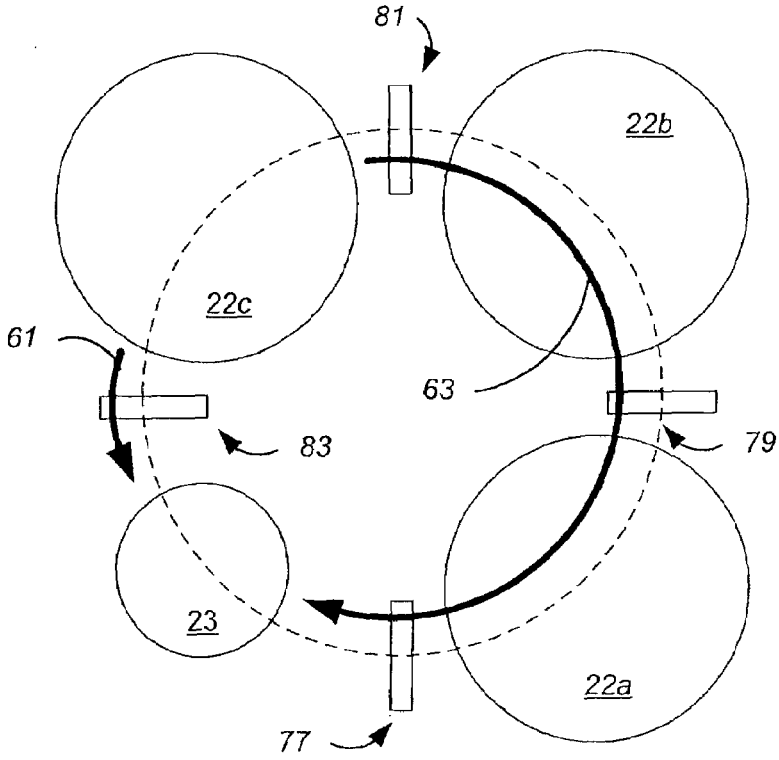
FIG. 6A shows a second arrangement of inter-platen modules.
Figure 6B:
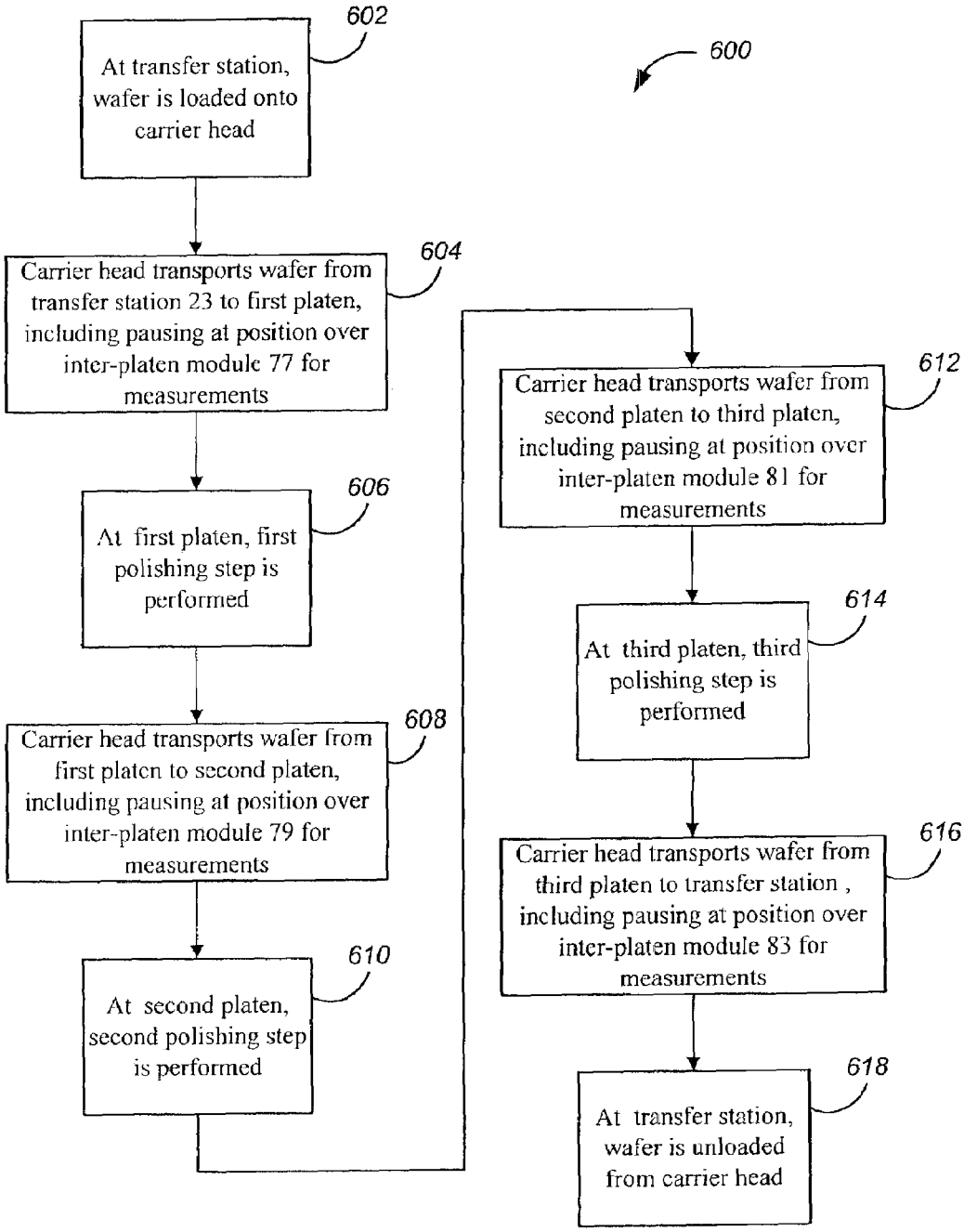
FIG. 6B shows a method for processing a wafer in a CMP apparatus that has the second arrangement of inter-platen modules.

FIGS. 6A and 6B show a case where polishing consists of three polishing steps, performed sequentially at the first, second, and third polishing stations. In this case, assume proper control requires measurements be taken before and after each polishing step. Consequently, four inter-platen monitoring modules are needed.

FIG. 6A shows an over head view of: (i) the first, second, and third platens of polishing stations 22*a*, 22*b*, and 22*c*, respectively, (ii) transfer station 23, and (iii) four inter-platen monitoring modules 77, 79, 81, and 83. As can be seen, the four inter-platen monitoring modules are situated between the four stations.

FIG. 6B shows a method 600 for processing a wafer (a type of substrate). At the transfer station 23, a current wafer is loaded onto a carrier head (step 602).

The carrier head transports the current wafer from transfer station 23 to the first platen, including pausing at or moving through one or more positions where inter-platen module 77 can effect measurements (step 604). When the current wafer is at a position where inter-platen monitoring module 77 can effect measurements, inter-platen monitoring module 77 takes one or more measurements, including a current film thickness of the current wafer.

Because the carrier head can pause or move through more than one position where measurements can be effected by an inter-platen monitoring module, more than one location on the current wafer can be measured by the inter-platen monitoring module. Thus, a inter-platen monitoring module can effect measurements at multiple locations on the current wafer as the wafer is being transported from one platen to another platen, from a platen to transfer station 23, or from transfer station 23 to a platen.

At the first platen, the first polishing step is performed (step 606). During the first polishing step, the in-situ monitoring module or modules of polishing station 22*a* perform in-situ measurements.

After completion of the first polishing step, the carrier head transports the current wafer from the first platen to the second platen, including pausing at or moving through one or more positions where inter-platen module 79 can effect measurements (step 608). When the current wafer is at a position where inter-platen monitoring module 79 can effect measurements, inter-platen monitoring module 79 takes one or more measurements, including a current film thickness of the current wafer.

Polishing time, polishing rate, and/or a wafer thickness profile can be calculated based on the inter-platen measurements obtained in the current step. The calculations can be used for polishing the current wafer at the second platen (i.e., feed forward) and/or for polishing a next wafer at the first platen (i.e., feedback). The calculation can be performed by, for example, the above described computer 90. Polishing time, polishing rate, and thickness profile calculation are further described below.

At the second platen, the second polishing step is performed (step 610). During the second polishing step, the in-situ monitoring module or modules of polishing station 22*b* perform in-situ measurements.

After completion of the second polishing step, the carrier head transports the current wafer from the second platen the third platen, including pausing at or moving through one or more positions where inter-platen module 81 can effect measurements (step 612). When the current wafer is at a position where inter-platen monitoring module 81 can effect measurements, inter-platen monitoring module 81 takes one or more measurements, including a current film thickness of the current wafer. Polishing time, polishing rate, and/or a wafer thickness profile can be calculated based on the inter-platen measurements obtained in the current step. The calculations can be used for polishing the current wafer at platen 3 and/or for polishing the next wafer at platen 2.

At the third platen, the first polishing step is performed (step 614). During the third polishing step, the in-situ monitoring module or modules of polishing station 22*c* perform in-situ measurements.

After completion of the third polishing step, the carrier head transports the current wafer from the third platen to transfer station 23, including pausing at or moving through one or more positions where inter-platen module 83 can effect measurements (step 616). When the current wafer is at a position where inter-platen monitoring module 83 can effect measurements, inter-platen monitoring module 83 takes one or more measurements, including a current film thickness of the current wafer. Polishing time, polishing rate, and/or a wafer thickness profile can be calculated based on the inter-platen measurements obtained in the current step. The calculations can be used for checking the post-polish thickness (or thickness profile) of the current wafer and/or polishing the next wafer at platen 3.

To effect the above-described transport of the current wafer from the third platen to the transfer station 23, the carrier head rotates counter clockwise (as indicated by arrow 61, FIG. 6A). However, in alternative implementations, the carrier head can effect the transport from the third platen to transfer station 23 by rotating clockwise (as indicated by arrow 63, FIG. 6A). In the latter case, one of inter-platen monitoring modules 77, 79, and 81 is used instead of inter-platen monitoring module 83.

At the transfer station, the wafer is unloaded from the carrier head (step 618). Another wafer can then be loaded onto the carrier head.

Typically, one or more gating wafers of a batch are processed before product wafers of the batch are processed. For a gating wafer, a removal rate for a platen can be calculated based on the pre-polished thickness and the post-polish thickness measured. A polish time can be calculated from the removal rate and be pre-set for the platen. For a product wafer, a post-polish thickness can be used to adjust the polish time of the platen. If post platen 1 thickness of a current wafer is thicker than expected, the polish time of platen 1 can be extended as appropriate for a subsequent wafer and/or the polish time of platen 2 can be extended for the current wafer. Moreover, removal rates can be calculated for product wafers, and the polish times of the platens can be adjusted to increase or maximize throughput. Note that adjustments and calculations can be effected based on averages of measurements for multiple wafers, for example, an average of measurements taken for five wafers.

In addition or as an alternative to using the measurements of the inter-platen monitoring modules to adjust polish times to achieve a target thickness, the measurements can be used to adjust polishing parameters to achieve a desired removal rate. In implementations where the carrier head can exert different pressures at difference portions of the wafer, the measurement can also be used to adjust the pressures of each zone to achieve a desired post-polish profile for the wafer. An example of a carrier that can exert different pressures at different portions of a wafer is provided in the above referenced U.S. Pat. Nos. 6,422,927 and 6,857,945.

In the above described implementations, an inter-platen monitoring module is positioned so that transporting a substrate from a first station to a position over the module and from the position over the module to a subsequent station does not require the carousel 60 to reverse its rotation about the carousel axis 64. That is, during the transport of the substrate from one station to another station, the carousel rotates about the carousel axis in only one direction (either clockwise or counter clockwise). The carousel may pause or slow down but does not reverse its rotation during the transfer. Note that, the carrier head may need to make movements not performed during a strictly station-to-station transfer (i.e., one performed without taking measurements). Such movement can be, for example, a translation of the carrier head along its radial slot.

In general, an inter-platen monitoring module can be positioned so that transporting a substrate from a first station (for performing a first polishing step) to a position over the module and from the position over the module to a second station (for performing a next polishing step) does not require the device transporting the substrate to reverse direction about or along any of the degrees of freedom of movement which use is required to effect the transport. A degree of freedom of movement can be, for example, rotation about an axis and translation along a path, either radial or otherwise. Motion about or along a degree of freedom of movement without a reverse in direction is said to be monotonic. For example, the rotation about axis 64 to move a substrate from the first station to the subsequent station described in the preceding paragraph is monotonic.

Figure 7:
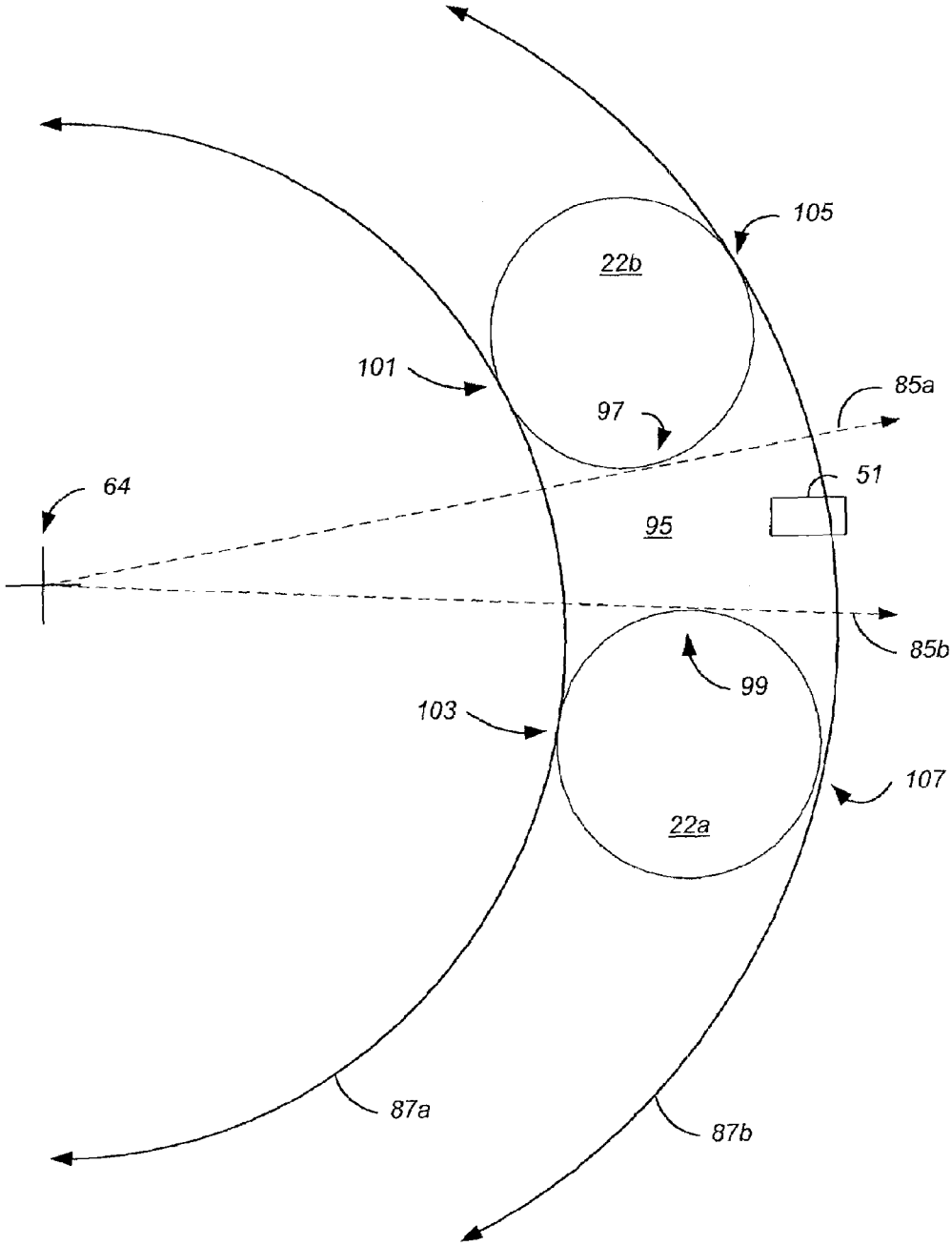
FIG. 7 shows an example of positions between stations where an inter-platen module can be placed.

FIG. 7 provides an example in which inter-platen modules are positioned in between polishing stations. Any point in annular section 95 is considered to be in between the polishing stations. Annular section 95 is defined by rays 85*a* and 85*b* and circles 87*a* and 87*b*. Rays 85*a* and 85*b* start at the carousel axis 64 and are tangent to the circumferences of the polishing stations 22*a* and 22*b* at the points 97 and 99, respectively. Circles 87*a* and 87*b* (only portions of which are shown) have centers that are at the carousel axis 64. Circle 87*a* is tangent to the circumference of the polishing stations 22*a* and 22*b* at points 101 and 103, respectively. Circle 87*b* is tangent to the circumference of the polishing stations 22*a* and 22*b* at points 105 and 107, respectively. When the platens do not have equal circumferences, the circles 87*a* and 87*b* are tangent to the circle having the greater circumference at points similar to those indicated so as to maximize the area of the annular section 95.

Optionally, the CMP apparatus 20 includes one or more flushing systems. A flushing system can, for example, use one or more fluids to provide consistently a homogeneous medium through which light can travel to and from the surface of the film that is to be or that has been polished. The fluid can flush away polishing residue, for example, slurry, from the surface of the film being measured.

Figure 8A:
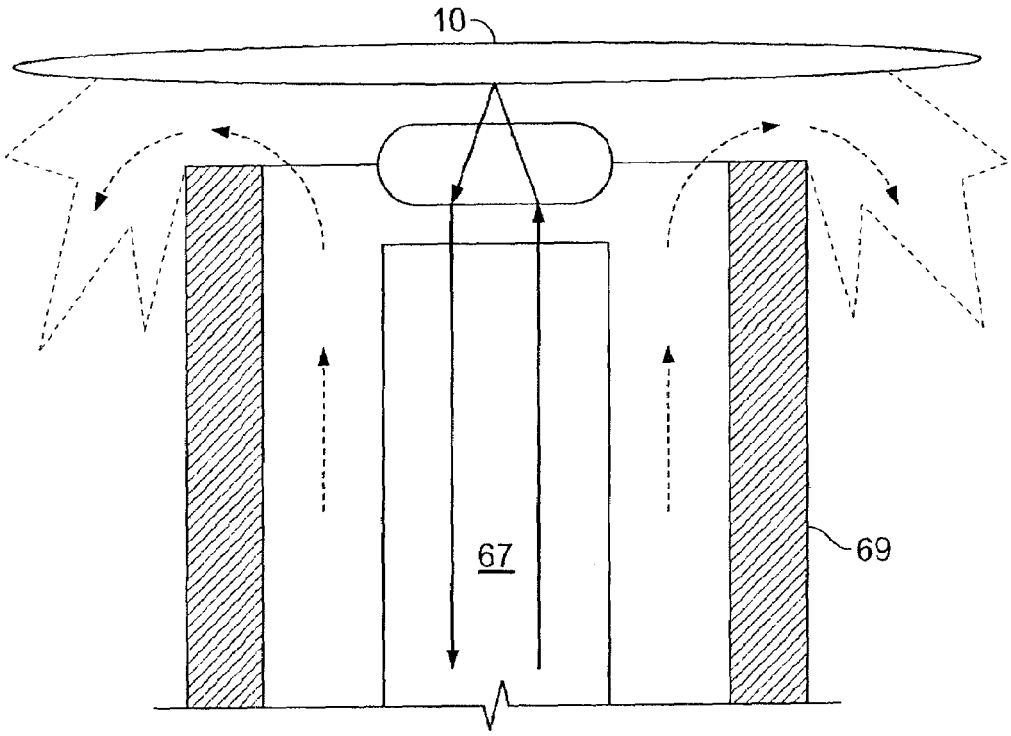
FIGS. 8A–8D show various implementations of a flushing system.

FIG. 8A shows an implementation of a flushing system for an inter-platen monitoring module. In this implementation, an optical fiber 67 is situated inside a tube 69, through which de-ionized water can be pumped. When the substrate is positioned over one end of the optical fiber, the optical fiber 67 directs light from a source 89 to the film. Light reflected from the film travels back through the optical fiber 67 to a sensor 91. The ends of the optical fiber 67 and tube 69 are situated so that a jet of de-ionized water washes away polishing residue and provides a homogeneous medium for light to travel to and from the film surface. The optical fiber can be a bifurcated fiber, or simply two adjacent optical fibers.

Figure 8B:
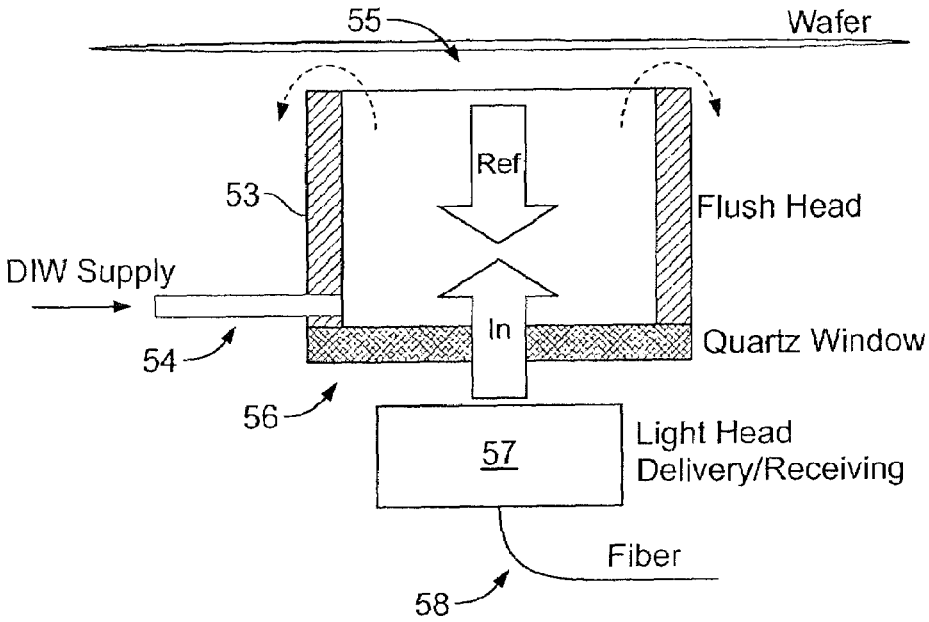

FIG. 8B shows another implementation of the flushing system, which includes a flush head 53 that includes an input port 54, an opening 55 that is adjacent to a substrate being polished, and a quartz window 56. There can be more than one input port. De-ionized water can be supplied to the flush head 53 through the port 54 and can exit the flush head 53 through the opening 55 that is adjacent to the substrate. A light head 57 operable to transmit and receive light is situated adjacent to the quartz window 56 so that light transmitted from and received by the light head 57 (i.e., incident light and reflected light, respectively) pass through the flush head 53 as illustrated. Light is provided to and received from the light head 57 through an optical fiber 58. Alternatively, the light source and sensor can be included in the light head, in which case the cable depicted can be an electrical cable rather than an optical fiber.

During in-situ monitoring, de-ionized water flows into the input port 54, through the flush head 53, out the opening 55, and impacts against a substrate surface where the incident light impinges (i.e., the substrate surface being measured). A constant flow of de-ionized water can thus wash away slurry as well as other optical impediments to incident and reflected light. Furthermore, a constant flow of slurry can provide a homogenous medium, i.e., the de-ionized water, through which incident and reflected light can pass.

Figure 8C:
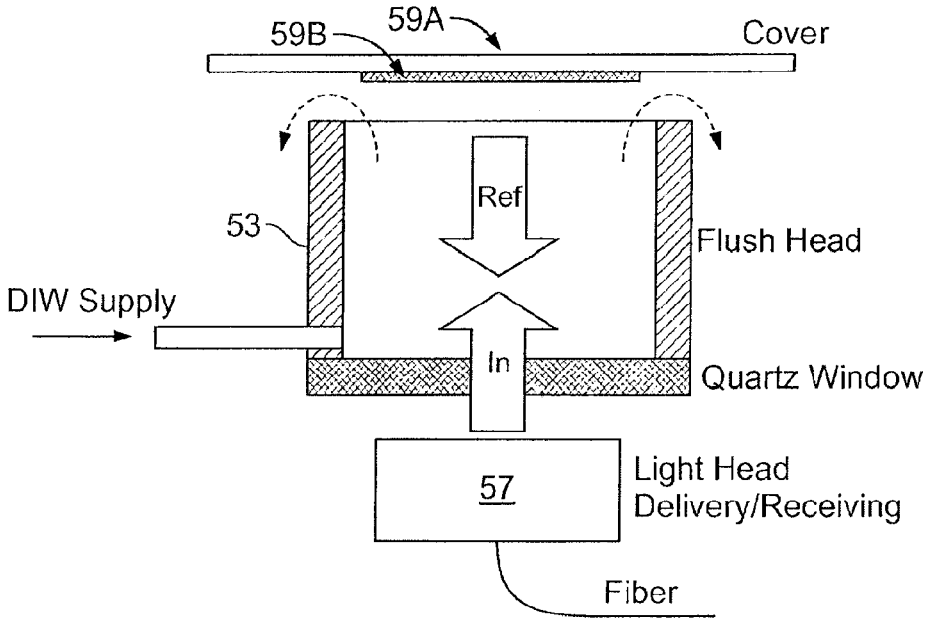

FIG. 8C shows another implementation of the flushing system, which is similar to the one described above in reference to FIG. 8B but includes a cover 59A for the flush head 53. The cover 59A is situated to cover the flush head 53 when measurements are not being taken during polishing, thus, protecting the flush head 53 and the light head 57 from contamination with slurry. During in-situ monitoring, the cover 59A is situated to expose the flush head 53 and permit monitoring and flushing.

The cover can include a reference reflector 59B, which can be a mirror or a piece of blank silicon wafer. The reflector 59B can be used to calibrate the one or more monitoring systems of an inter-platen monitoring-module before each measurement performed by the inter-platen monitoring module. Calibration can account for long term and short term spectrum drifts of the light source and, thus, facilitate accurate measurements.

Figure 8D:
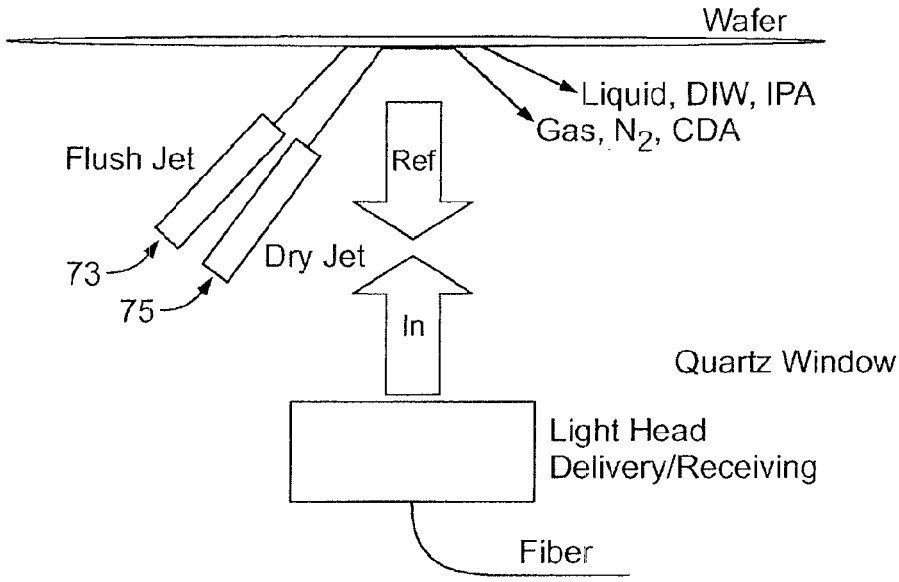

FIG. 8D shows another implementation of the flushing system, which includes a flush jet source 73 and a dry jet source 75. The flush jet source produces a jet of liquid, which can be de-ionized water or IPA. The dry jet source produces a jet of gas, which can be $N_2$ or CDA. The sources are aimed at the substrate surface being measured.

During in-situ monitoring, the substrate surface to be measured is first washed with a jet of liquid and then dried with a jet of gas. Measurements can then be effected.

Optionally, the CMP apparatus 20 can include one or more position sensors situated and configured to detect and determine when an inter-platen module are beneath a substrate. Examples of position sensors include an optical signal interrupter and an encoder configured to determine angular positions of the carousel and the inter-platen sensor. In general, the optical interrupter operates by having a flag, which can be made of a material that blocks light, that is strategically positioned to block a light signal when the workpiece is positioned over the sensor. An interruption in the light signal, thus, indicates that the workpiece is positioned over the sensor. Measurements of the workpiece can thus be taken during the interruption.

Alternatively or in addition to the above-described flag mechanism, a cross rotation motor having an encoder can be implemented to detect and determine when the inter-platen module are beneath a workpiece. In general, the encoder senses the rotational position of the carousel 60 and can indicate when a workpiece being held by one of the carousel's carrier heads overlies an inter-platen monitoring module.

A general purpose programmable digital computer, for example, the above described computer 90, can be configured to receive signals from the inter-platen modules. The computer can be programmed to sample measurements from the monitoring system when the substrate generally overlies the sensors of the inter-platen modules (as determined, for example, by the above described position sensor). The computer can perform the above described calculations and adjustments. The computer can, for example, calculate film thickness and adjust the polishing time of: (i) the previous polishing step, i.e., the polishing time for a subsequent substrate at the polishing station that the substrate being measured just left, (ii) the subsequent polishing step, i.e., the polishing time at the polishing station to which the substrate being measured will be transferred, or (iii) both of items (i) and (ii). Adjustment can be based on the equation:

$$\text{Change in thickness} = \text{Polishing Rate} \times \text{Polishing Time} \qquad \text{(Eq. 1)}$$

The polishing rate can usually be empirically derived and typically changes as consumables, for example, the polishing pad, wear with use and age. The computer can use the polishing time to determine when an end point has been achieved. An end point is reached, for example, when the polishing time of the last polishing step has expired.

Alternatively or additionally, the computer can adjust a polishing rate. Such adjustments can be effected by changing controllable polishing parameters, for example, carrier head rotation speed, slurry flow, conditioning, and the amount of force used to press a substrate against a polishing pad.

The computer can be programmed to determine a radial position on the substrate for each measurement made by the inter-platen monitoring module and/or to sort the measurements into radial ranges. The computer can calculate a wafer thickness profile by calculating a layer thickness for each radial range.

The inter-platen modules can be used in a variety of polishing systems. Either the polishing pad, or the carrier head, or both can move to provide relative motion between the polishing surface and the substrate. The polishing pad can be a circular (or some other shape) pad secured to the platen, a tape extending between supply and take-up rollers, or a continuous belt. The polishing pad can be affixed on a platen, incrementally advanced over a platen between polishing operations, or driven continuously over the platen during polishing. The pad can be secured to the platen during polishing, or there could be a fluid bearing between the platen and polishing pad during polishing. The polishing pad can be a standard (for example, polyurethane with or without fillers) rough pad, a soft pad, or a fixed-abrasive pad.

The inter-platen modules may collect sufficient information without requiring the use of in-situ monitoring modules to effectively monitor and control a polishing process.

The inter-platen monitoring modules can be implemented for various polishing processes, including but not limited to those for shallow trench isolation, polishing inter-layer dielectric, inter-metal dielectric, pre-metal dielectric, silicon on insulator, and poly materials.

Although described in the context of polishing of an oxide layer, some aspects of the invention would be applicable to polishing of other dielectric layers and metals layers, for example, a layer of tungsten or copper. The polished layer can be a barrier layer.

The above described inter-platen module can use other types of lights other than those described. The module can use, for example, ultraviolet light or infrared light.

Computer programs to carry out the invention may be tangibly embodied in computer-readable medium, for example, disks or memory of the above described computer.

The present invention has been described in terms of a preferred embodiment. The invention, however, is not limited to the embodiment depicted and described. Rather, the scope of the invention is defined by the appended claims.

What is claimed is:

1. A chemical mechanical polishing system, comprising:
a first polishing station;
a second polishing station;
a transport device configured to hold a workpiece during polishing at the first and second polishing stations and to transport the workpiece from the first polishing station to the second polishing station, wherein the transport device includes a carrier head configured to hold the workpiece; and
a first inter-platen measuring station situated and configured to measure a characteristic of the workpiece when the transport device is holding the workpiece and when the workpiece is not in contact with a polishing pad of any of the first polishing station and the second polishing station, and wherein the carrier head is configured to hold the workpiece during measurement at the inter-platen measuring station.

2. The system of claim 1, wherein:
the first inter-platen measuring station is situated to measure a characteristic of the workpiece when the transport device is transporting the workpiece from the first polishing station to the second polishing station.

3. The system of claim 1, wherein:
the first inter-platen measuring station includes a probe configured to measure the characteristic by optically scanning the workpiece.

4. The system of claim 3, further comprising:
a device to flush the probe with clear fluid to remove polishing fluid.

5. The system of claim 4, wherein:
the clear fluid is one of de-ionized water and air.

6. The system of claim 1, wherein:
the transport device is configured to transport the workpiece from the first polishing station to the second polishing station along a particular path;
the transport device has a first degree of freedom of movement; and
the movement of the workpiece during transport along the particular path is monotonic with respect to the first degree of freedom of movement.

7. A chemical mechanical polishing system, comprising:
a first polishing station;
a second polishing station;
a transport device configured to hold a workpiece during polishing at the first and second polishing stations and to transport the workpiece from the first polishing station to the second polishing station along a particular path; and
a first inter-platen measuring station, located along the particular path between the first and second polishing stations; wherein:
the first polishing station and the second polishing station are at different points along the particular path;

the transport device is configured to transport the workpiece from the first polishing station, passing over the measuring station, to the second polishing station without reversing direction along the particular path; and the measuring station is situated to measure a characteristic of the workpiece when the transport device is holding the workpiece and when the workpiece is not in contact with a polishing pad of any of the first polishing station and the second polishing station.

8. The system of claim 1, wherein:

the transport device is configured to do one of stop and slow down when the workpiece is over the measuring station.

9. The system of claim 6, wherein the transport device includes:

a carousel configured to rotate about an axis, rotation about the axis being the first degree of freedom of movement.

10. The system of claim 9, wherein the carrier head is configured to translate the workpiece in a direction parallel to the axis, translation parallel to the axis being a second degree of freedom of movement.

11. The system of claim 9, wherein the carrier head is configured to radially translate the workpiece away or toward the axis, radial translation being a second degree of freedom of movement.

12. The system of claim 1, wherein the first polishing station is configured to polish at a first polishing rate and a first polishing time and the second polishing station is configured to polish at a second polishing rate and a second polishing time, the system further comprising:

a processor configured to receive measurement information from the first inter-platen measuring station and use the measurement information to adjust the first polishing rate, the second polishing rate, the first and second polishing rates, the first polishing time, the second polishing time, or the first and second polishing times.

13. The system of claim 1, wherein:

the first and second polishing stations are configured to effect polishing steps of a shallow trench isolation process, a process for polishing inter-layer dielectric, a process for polishing inter-metal dielectric, a process for polishing silicon on insulator, a process for polishing pre-metal dielectric, a process for polishing a poly materials, a process for polishing copper, a process for polishing tungsten, or a process for polishing a barrier layer.

14. The system of claim 1, further comprising:

a third polishing station; and a second measuring station situated to measure the characteristic of the workpiece when the transport device is transporting the workpiece from the second polishing station to the third polishing station and when the workpiece is not in contact with a polishing pad of any of the second polishing station and the third polishing station.

15. The system of claim 1, wherein:

the first measuring station is configured to measure the characteristic by using spectrometry, interferometry, elipsometry, or an eddy current technique.

16. The system of claim 15, wherein:

the workpiece is a wafer; and the first inter-platen measuring station is configured to measure the characteristic over a die of the wafer.

17. The system of claim 1, further comprising:

a transfer station; and a second measuring station situated to measure the characteristic of the workpiece when the transport device is transporting the workpiece from the transfer station to the first polishing station and when the workpiece is not in contact with the first polishing pad.

18. The system of claim 1, wherein:

at least one sensor of the first measuring station is situated at a point along a path, along which the transport device would move the workpiece from the first polishing station to the second polishing station if no measurements were being taken.

19. The system of claim 1, wherein:

the transport device has two degrees of freedom of movement that allows the transport device to carry the workpiece along a particular path;

the first polishing station and the second polishing station are at different points along the particular path; and the transport device is configured to transport the workpiece from the first polishing station, passing over the measuring station, to the second polishing station without reversing direction along the particular path.

20. The system of claim 1, wherein:

the transport device has a first degree of freedom of movement required to transport the workpiece from the first polishing station to the second polishing station; and the transport device is configured to transport the workpiece from the first polishing station to the second polishing station by monotonically moving about or along the first degree of freedom of movement.

21. The system of claim 20, wherein:

the transport device is configured to transport the workpiece by moving about or along the first degree of freedom of movement at a substantially constant rate.

22. The system of claim 1, wherein the first polishing station is configured to effect a polishing step in accordance with polishing parameters, the system further comprising:

a processor configured to receive measurement information from the first inter-platen measuring station and use the measurement information to adjust the polishing parameters to achieve a target thickness profile of the workpiece.

23. A chemical mechanical polishing method, comprising:

polishing a workpiece with a first polishing pad at a first polishing station;

transporting the workpiece with a transport device from the first polishing station to a second polishing station that includes a second polishing pad, wherein transporting of the workpiece is performed by a transport device comprising one or more carrier heads; and measuring a characteristic of the workpiece when the workpiece is being held by the transport device and when the workpiece is not in contact with either the first or second polishing pads, wherein measurement of a characteristic of the workpiece is performed while the workpiece is being held by one of the carrier heads.

24. The method of claim 23, wherein:

an inter-platen measuring station situated between the first and second polishing stations performs the measuring.

25. The method of claim 23, wherein:

the transporting is effected by a transport device that has multiple degrees of freedom of movement; and the measuring is performed by a first inter-platen measuring station that is situated to scan the workpiece when the transport device uses only two of its degrees of freedom of movement to move the workpiece from the first polishing station to the second polishing station.

26. The method of claim 23, wherein the first polishing station is configured to polish at a first polishing rate, the method further comprising:

adjusting the first polishing rate, the adjusting being based on information obtained from the measuring.

27. The method of claim 23, wherein the second polishing station is configured to polish at a second polishing rate, the method further comprising:

adjusting the second polishing rate, the adjusting being based on information obtained from the measuring.

28. A chemical mechanical polishing method, comprising:

polishing a workpiece with a first polishing pad at a first polishing station;

transporting the workpiece along a particular path from the first polishing station to a second polishing station that includes a second polishing pad, wherein transporting is done by a transport device having one or more carrier heads, and wherein the particular path is the same path along which the transport device moves the workpiece from the first polishing station to the second polishing station when no measurements of the workpiece characteristics are being taken; and measuring a characteristic of the workpiece at a first inter-platen measuring station that is situated along the particular path, when the workpiece is being held by the transport device and when the workpiece is not in contact with either the first or second polishing pads.

29. The system of claim 1, wherein:

the first inter-platen measuring station is situated between the first polishing station and the second polishing station.

30. The system of claim 1, further comprising:

a controller configured to cause the measuring station to measure a characteristic of the workpiece when the transport device is holding the workpiece and when the workpiece is not in contact with a polishing pad of any of the first polishing station and the second polishing station.

* * * * *